US005913094A

United States Patent [19]

Endo

[11] Patent Number: 5,913,094

[45] Date of Patent: Jun. 15, 1999

[54] DEVELOPING DEVICE HAVING MAGNETIC SEALS AT END PORTIONS OF A DEVELOPER CARRYING MEMBER AND A ROTATING REGULATING MEMBER

[75] Inventor: Saijiro Endo, Tokyo, Japan

[73] Assignee: Canon Kabushiki Kaisha, Tokyo, Japan

[21] Appl. No.: 08/678,745

[22] Filed: Jul. 11, 1996

[30] Foreign Application Priority Data

Jul. 18, 1995 [JP] Japan ..... 7-202714

[51] Int. Cl.[6] ..... G03G 15/095; G03G 21/00

[52] U.S. Cl. ..... 399/104; 399/274; 399/282

[58] Field of Search ..... 399/104, 272, 399/274, 275, 282

[56] References Cited

U.S. PATENT DOCUMENTS 4,341,179 7/1982 Hosono et al. ..... 399/104
4,559,899 12/1985 Kan et al. ..... 399/104
5,187,326 2/1993 Shirai ..... 399/104
5,267,007 11/1993 Watanabe et al. ..... 399/104
5,517,286 5/1996 Tada et al. ..... 399/274

*Primary Examiner*—William Royer
*Attorney, Agent, or Firm*—Fitzpatrick, Cella, Harper & Scinto

[57] ABSTRACT

A developing device includes a developing sleeve for carrying a magnetic developer, a regulating sleeve for regulating the thickness of the layer of the developer on the developing sleeve, magnets for generating a magnetic field in a layer-thickness regulating portion by the regulating sleeve, and magnetic members provided so as to have a small gap between the circumferences of the developing sleeve and the regulating sleeve. Leakage of the developer from end portions is prevented by forming a magnetic seal by way of a magnetic field between each of the magnetic members, and between the regulating sleeve and the developing sleeve.

10 Claims, 8 Drawing Sheets

DEVELOPING DEVICE HAVING MAGNETIC SEALS AT END PORTIONS OF A DEVELOPER CARRYING MEMBER AND A ROTATING REGULATING MEMBER

BACKGROUND OF THE INVENTION

1. Field of the Invention

This invention relates to a developing device for developing an electrostatic image on an image carrying member which is used in an image forming apparatus, such as an electrophotographic apparatus, an electrostatic recording apparatus or the like.

2. Description of the Related Art

FIG. 6 illustrates a conventional developing device which uses a one-component magnetic developer (developing powder). This developing device includes a developing receptacle 3 containing a magnetic toner T, serving as a one-component magnetic developer. A developing sleeve 1*a*, serving as developer supporting means, is provided within the developing receptacle 3 at an opening facing a photosensitive drum 100, serving as an image bearing member, so as to be rotatable in the direction of the arrow "a". The developing sleeve 1*a* comprises a nonmagnetic member and incorporates a nonrotating magnet 1*b*, serving as magnetic-field generation means. A developer conveying member 4 is provided at a rear portion of the developing receptacle 3, and conveys the toner T toward the developing sleeve 1*b*. A magnetic blade 2 is provided above the developing sleeve 1*a* at a portion of the opening of the developing receptable 3. One of magnetic poles N of the magnet 1*b* within the developing sleeve 1*a* faces the magnetic blade 2 to provide a developer regulating portion. The magnetic blade 2 is disposed so as to maintain a constant predetermined gap W with the developing sleeve 1*a*. In general, the gap W is set within the range of 100 $\mu$m–1 mm.

In the above-described developing device, the magnetic toner T contained in the developing receptacle 3 is carried on the developing sleeve 1*a* by the force of the magnetic field generated by the magnet 1*b*, and is conveyed toward a developing region facing the photosensitive drum 100 by the rotation of the developing sleeve 1*a*. The magnetic toner T is regulated at the regulating portion by the magnetic blade 2, and is coated as a thin layer on the developing sleeve 1*a*. As shown in FIG. 7, the thickness of this thin toner layer is determined by the position of a broken line L which passes between the developing sleeve 1*a* and the magnetic blade 2 so as to be parallel with the surface of the developing sleeve 1*a*.

According to the investigations of the inventor of the present invention, the provision of electric charges, the conveying mechanism, and the behavior of the magnetic toner T when it passes between the developing sleeve 1*a* and the magnetic blade 2 have turned out to relate as will now be discussed.

As shown in FIG. 8, two planes perpendicular to a line obtained by connecting the magnetic blade 2 to the developing sleeve 1*a* are considered. The plane closer to the magnetic blade 2 is designated by $\alpha$1, and the plane closer to the developing sleeve 1*a* is designated by $\alpha$2. In general, since the width of the magnetic blade 2 (the length in the circumferential direction of the developing sleeve 1*a*) is narrower than the width of the magnetic pole N of the magnet 1*b*, the magnetic flux density of the magnetic field from the magnetic pole N of the magnet 1*b* at the plane $\alpha$1 is greater than that at the plane $\alpha$2. Hence, the magnetic toner T carried on the developing sleeve 1*a* is under the influence of a magnetic force converging toward the magnetic blade 2 between the developing sleeve 1*a* and the magnetic blade 2, as indicated by the arrows "h" in FIG. 8.

As a result, as indicated by B in FIG. 7, the magnetic toner T forms "ears" issuing from the magnetic blade 2 toward the developing sleeve 1*a* between the magnetic blade 2 and the developing sleeve 1*a*. Toner particles t1 at the distal ends of the ears contact the developing sleeve 1*a*, and triboelectric charges are supplied to the toner particles t1 at the distal ends of the ears of the magnetic toner T.

The toner particles t1 at the distal ends of the ears of the toner T, to which the triboelectric charges are supplied to develop a latent image, adhere to the developing sleeve 1*a* due to an electrostatic mirror force. The toner particles t1 also are provided with a conveying force in the direction of the rotation of the developing sleeve 1*a* due to a frictional force with the developing sleeve 1*a*. At that time, since a certain amount of cohesive force exists between respective toner particles, a conveying force as a result of the cohesive forces is also generated in toner particles t2 in the second layer contacting the toner particles t1 at the distal ends of the ears. Similarly, a conveying force as a result of the cohesive force is generated in toner particles t3 in the third layer immediately above the second layer t2.

However, the above-described magnetic force in the direction of the magnetic blade 2 is exerted on toner particles between the developing sleeve 1*a* and the magnetic blade 2. Accordingly, the conveying force exerted on the toner particles exceeds the magnetic force at a certain position. If it is assumed that this position corresponds to the above-described broken line L, the ears of the toner particles are disconnected at the broken line L, and the toner particles at the side of the developing sleeve 1*a* are conveyed in the direction of rotation thereof.

On the other hand, as indicated by A shown in FIG. 7, toner particles having insufficient electric charges are present at the side of the magnetic blade 2. If a toner pool formed by these remaining toner particles grows, the magnetic force cannot hold the toner particles on the magnetic blade 2, and a group of toner particles having insufficient electric charges breaks away from the toner pool and is conveyed in the direction of the rotation of the developing sleeve 1*a*.

As is apparent from the foregoing description, sufficient electric charges can be supplied only to the toner particles t1 in the first layer on the developing sleeve 1*a*, and some toner particles conveyed by the developing sleeve 1*a* are not supplied with the necessary electric charge. As a result, conventionally, in some cases, development becomes unstable due to unstable charging of toner particles, and therefore high quality images cannot be stably obtained.

In order to solve the above-described problems, the assignee of the present application has proposed, in U.S. Pat. No. 5,517,286, application Ser. Nos. 08/250,682 and 08/348,222, devices for regulating the thickness of the layer of a developer using a layer-thickness regulating rotating member rotating in a direction opposite to a developing sleeve.

FIG. 9 illustrates one such device. This developing device includes a developing receptacle 3 for containing a magnetic toner T, serving as an insulating one-component magnetic developer. A developing sleeve 1*a* for receiving the magnetic toner T is provided so as to be rotatable in the direction of the arrow "b" within the receptacle 3 at an opening facing an electrophotographic photosensitive drum 100 rotating in the direction of the arrow "a". The developing sleeve 1*a* is made of a nonmagnetic material, such as aluminum or the like, and incorporates a nonrotating magnetic roller 1*b*. Two adjacent developer conveying members 4*a* and 4*b* for conveying the magnetic toner T within the receptacle 3 to the developing sleeve 1*a* by rotating in the directions of the arrows "c" and "d" are provided at a rear portion of the developing receptable 3.

According to this method, a thickness regulating means 6A, comprising a regulating sleeve 6*a* made of a nonmagnetic material, such as aluminum or the like, and a nonrotating magnet roller 6*b* incorporated therein, is provided close to the developing sleeve 1*a* at an upstream side from a developing region provided by the photosensitive drum 100 and the developing sleeve 1*a* facing each other in the direction of the rotation of the developing sleeve 1*a*. The regulating sleeve 6*a* rotates in the direction of the arrow "e", i.e., in the same direction as the developing sleeve 1*a*. That is, the developing sleeve 1*a* and the regulating sleeve 6*a* move with each other at a portion where the distance between the two sleeves is smallest.

A nonmagnetic elastic scraper 7, made of a synthetic resin or the like, for removing toner particles adhering to the regulating sleeve 6*a* contacts the surface thereof.

In FIG. 9, the stationary magnet roller (a permanent magnet) 1*b* within the developing sleeve 1*a* has six magnetic poles, S1, S2, S3, N1, N2 and N3, where S indicates a south pole, and N indicates a north pole.

The magnetic pole N2 is a developing magnetic pole for generating a magnetic field in the developing region, and is disposed where the distance between the developing sleeve 1*a* and the photosensitive drum 100 is smallest. The magnetic pole N1 has a function of regulating the toner layer in cooperation with the regulating means 6A, as will be described later. The other magnetic poles S1, S2, S3 and N3 have a function of magnetically attracting toner particles onto the magnetic sleeve 1*a* to assist conveyance of the toner particles caused by the rotation of the developing sleeve 1*a*.

On the other hand, in FIG. 9, the stationary magnet roller (a permanent magnet) 6*b* within the regulating sleeve 6*a* has two magnetic poles S4 and N4, which are positioned so that the magnetic pole N1 and the magnetic pole S4 having an opposite polarity magnetically attract each other. Accordingly, magnetic lines of force are continuous between the two magnetic poles, and a strong magnetic field is generated in a gap W between the developing sleeve 1*a* and the regulating sleeve 6*a*, i.e., between the magnetic poles N1 and S4.

The magnetic field generated between the magnetic poles N1 and S4 prevents the magnetic toner from flowing through the gap W between the developing sleeve 1*a* and the regulating sleeve 6*a*, i.e., the regulating portion toward the developing region.

Since the regulating sleeve 6*a* moves in a direction opposite to the moving direction of the developing sleeve 1*a* where they face each other, a frictional force is exerted on the toner contacting the regulating sleeve 6*a* by the function of the above-described magnetic field to provide a conveying force in the direction of rotation of the regulating sleeve 6*a*, i.e., a conveying force in a direction opposite to the conveying direction by the developing sleeve 1*a*. This conveying force is also transmitted to toner particles remote from the regulating sleeve 6*a* due to the frictional force and the cohesive force exerted between respective toner particles. As a result, the conveying force from the regulating means 6A in the direction of rotation of the regulating sleeve 6*a*, i.e., in a direction toward the rear side of the receptacle 3, is exerted on the toner at the regulating portion.

As described above, electric charges generated by friction with the developing sleeve 1*a* are supplied to the magnetic toner in the first layer contacting the developing sleeve 1*a*. The toner is attracted onto the developing sleeve 1*a* by the mirror force produced by the electric charges, and a conveying force in the direction of rotation of the developing sleeve 1*a* is exerted on the toner by the frictional force with the developing sleeve 1*a*.

Since such a developing device can supply the developing portion with only sufficiently charged toner particles, the quality of the developed image is improved.

It is necessary to seal the spaces between the receptacle 3 and the developing sleeve 1*a* and between the receptacle 3 and the regulating sleeve 6*a* in order to prevent toner particles adhering to the surface of the sleeves from flowing in the axial directions of the sleeves. For that purpose, sealing members (made of a wool, felt, or the like) may be positioned in pressure contact with the surface of each of the sleeves. As a result, the driving torque for rotating the regulating sleeve 6*a* and the developing sleeve 1*a* increases.

In the device shown in FIG. 9, a certain amount of driving torque for rotating the regulating sleeve 6*a* is required. In addition, since the elastic scraper 7, serving as a cleaning member, contacts the surface of the regulating sleeve 6*a* in order to remove toner particles adhering thereto, a considerable additional amount of driving torque for rotating the regulating sleeve 6*a* is required.

As a result, the driving torque required for the developing device becomes considerably higher than when using a magnetic blade as shown in FIG. 6. A larger driving torque naturally requires a higher-performance drive motor, resulting in increases in cost and space.

Since a high driving torque tends to produce nonuniform rotation at an interlocking pitch between gears or the like, smooth rotation of the sleeve cannot be obtained, and the obtained image may be degraded.

In a driving system shown in FIG. 12, an increase in the torque of a regulating sleeve 6 results in an increase in a force $F_\theta$ generated between a gear 6*g* of the regulating sleeve 6 and a gear 25*g* meshing with the gear 6*g*. As shown in FIG. 13, an increase in the force $F_\theta$ generates a reaction force $F'_\theta$ making the receptacle 3 function as a fulcrum. As a result, a central portion of the regulating sleeve 6 is deflected in the direction of an arrow Z shown in FIG. 12. If the central portion of the regulating sleeve 6*a* is deflected, the gap W (FIG. 9) between the regulating sleeve 6*a* and the developing sleeve 1*a* becomes nonuniform in the axial directions of the sleeves. That is, the gap W has a smaller value at the central portion in the axial directions of the sleeves. Since, as shown in FIG. 14, the gap W greatly influences the thickness of the toner layer, the thickness of coated toner particles at the central portion becomes, in some cases, smaller than that at end portions of the sleeves.

If the contact pressure of the sealing members is reduced in order to reduce such an increase in the driving torque, the effectiveness of sealing is reduced.

In addition, since both ends of the developing sleeve and the regulating sleeve must be sealed, the sealing members must have a complicated configuration.

SUMMARY OF THE INVENTION

It is an object of the present invention to provide a developing device having a reduced driving torque.

It is another object of the present invention to provide a developing device in which leakage of a developer from end portions of a developer carrying member and a regulating rotating member is prevented with a simple configuration.

According to one aspect, the present invention, which achieves these objectives, relates to a developing device comprising a rotating developer carrying member for carrying a magnetic developer, a regulating rotating member for regulating the thickness of the developer on the developer carrying member, magnetic-field generation means for generating a magnetic field between the developer carrying member and the regulating rotating member, and magnetic members, provided at end portions of the developer carrying member and the regulating rotating member disposed along the circumferences thereof, the developer carrying member and the regulating rotating member being disposed such that a predetermined gap exists therebetween.

The foregoing and other objects, advantages and features of the present invention will become more apparent from the following description of the preferred embodiments taken in conjunction with the accompanying drawings.

DESCRIPTION OF THE PREFERRED EMBODIMENTS

Preferred embodiments of the present invention will now be described with reference to the drawings.

Figure 9:
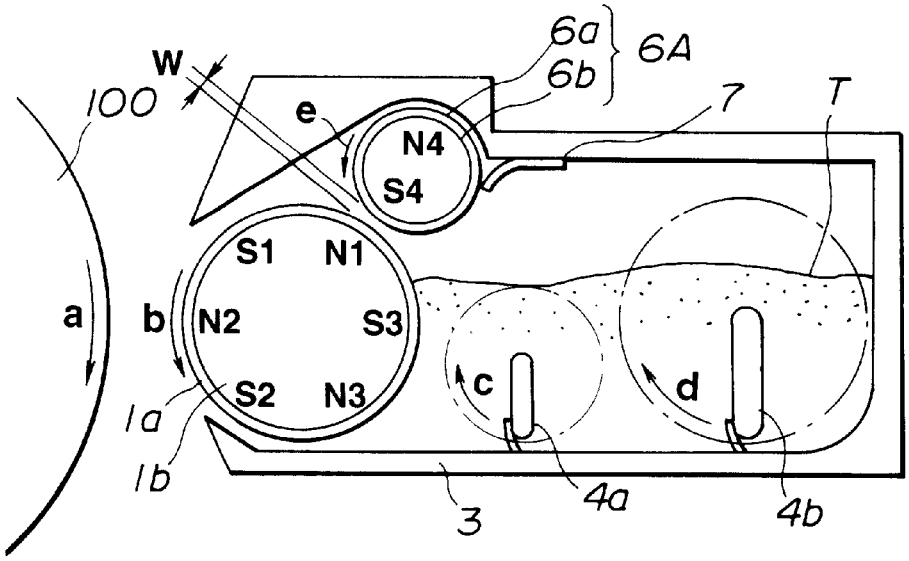
FIG. 9 is a cross-sectional view illustrating a developing device including a regulating sleeve.

A developing device according to a first embodiment of the present invention has the same configuration as the device shown in FIG. 9 except for the sealing members. Hence, the above-given description of the related art also applies the device of the first embodiment, and will not now be repeated.

Figure 10:
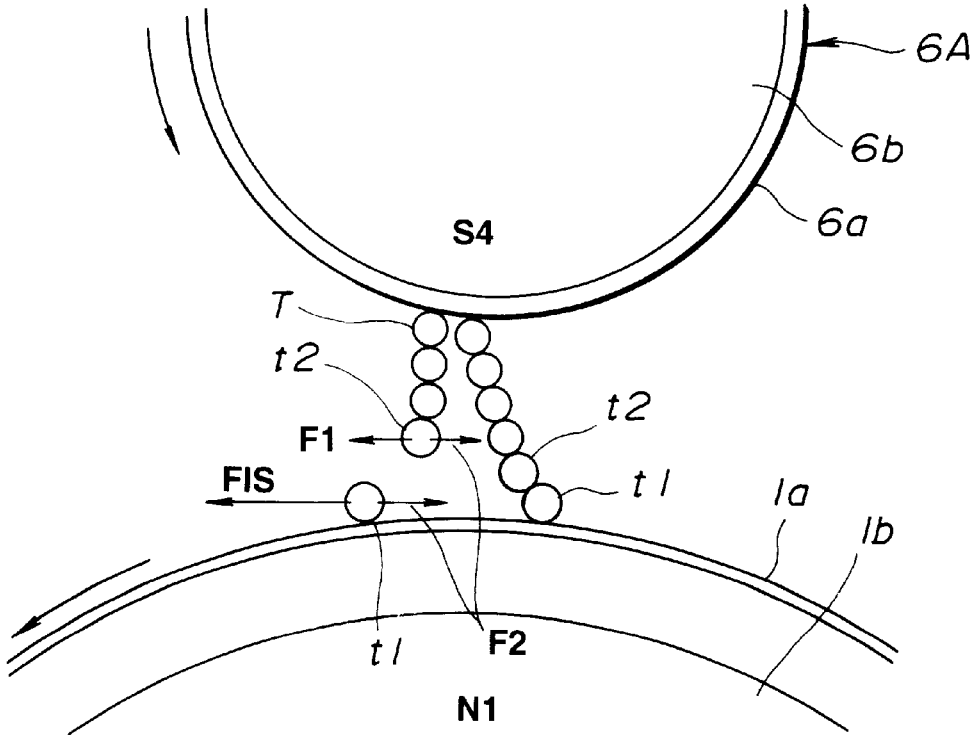
FIG. 10 is a diagram illustrating a state of toner particles in the vicinity of the regulating sleeve in the developing device shown in FIG. 9.

In the first embodiment, the magnetic poles N1 and S4 face each other provide the following state indicated in FIGS. 9 and 10.

The magnet roller 1*b* of the developing sleeve 1*a* is fixed and held so that the magnetic pole N1 is situated at the position shown in FIG. 10. On the other hand, the magnet roller 6*b* of the regulating sleeve 6*a* is held so as to be rotatable around its central axis. Then, the magnet roller 6*b* rotates to an angular position where it stops as a result of the attractive magnetic force between the magnetic poles S4 and N1. In this state, the magnetic poles N1 and S4 face each other.

As shown in FIG. 10, a conveying force F1S corresponding to the amount of charge of the toner particles t1 from the developing sleeve 1*a* and a conveying force F2 from the regulating means 6A (the regulating sleeve 6*a*) are exerted on the toner particles t1 in the first layer contacting the developing sleeve 1*a* in the magnetic toner T present at the developer regulating portion between the regulating sleeve 6*a* and the developing sleeve 1*a* as main conveying forces.

A conveying force F1 from the developing sleeve 1*a* and a conveying force F2 from the regulating means 6A (because this conveying force is substantially the same as the above-described conveying force F2) are exerted on the magnetic toner particles t2 in the second layer, which is above the first layer and does not contact the developing sleeve 1*a*, via the cohesive force between toner particles as main conveying forces.

Accordingly, if the following relationships $F1<F2$- - - (1), and $F2<F1S$ - - - (2)

hold between these conveying forces, only the toner particles and in the first layer, which have been sufficiently charged in contact with the developing sleeve 1*a*, are conveyed to the developing region.

On the other hand, insufficiently charged toner particles separated from the toner particles in the first layer are returned into the receptable 3 by the rotation of the regulating sleeve 6*a*. The toner particles returned within the receptacle 3 may again be supplied to the developing sleeve 1*a*.

It is preferable that the width of the 50% value of the magnetic flux density of the magnetic pole S4 is smaller than the width of the 50% value of the magnetic flux density of the magnetic pole N1.

Thus, the magnetic flux density of the magnetic field generated between the magnetic poles N1 and S4 increases from the developing sleeve 1*a* toward the regulating means 6A. It is thereby possible to increase the toner conveying force due to the presence of the regulating sleeve 6*a*.

Figure 11:
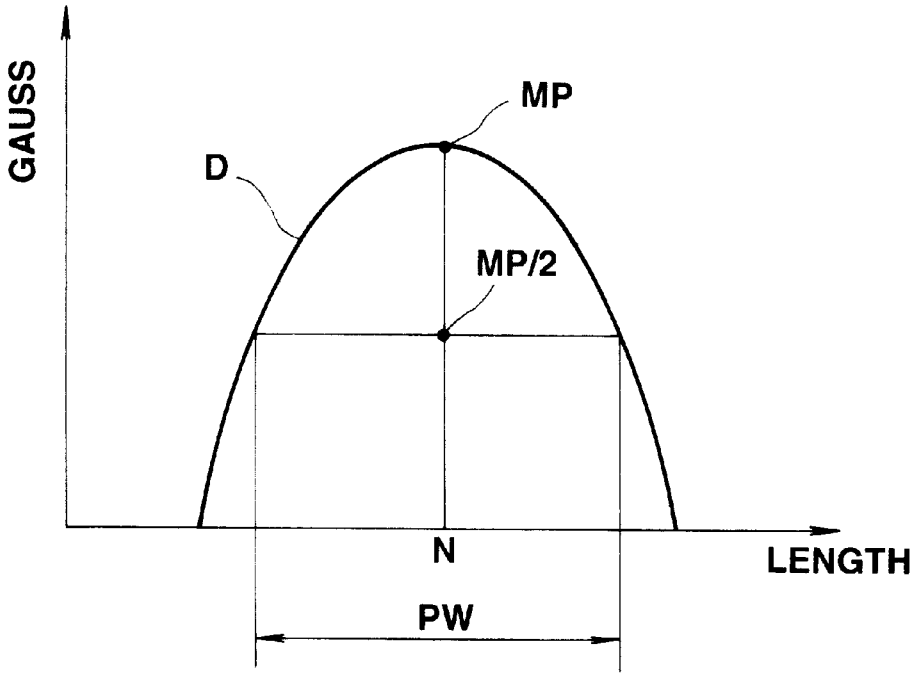
FIG. 11 is a graph illustrating the width of the 50% value of a magnetic pole of a magnet in the developing device shown in FIG. 9.
Figure 12:
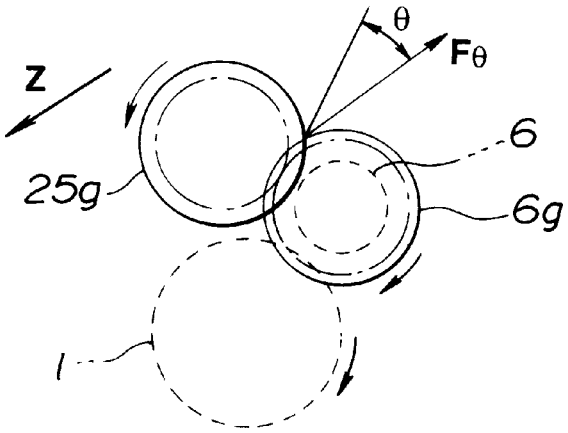
FIG. 12 is a diagram illustrating the configuration of input to drive the regulating sleeve in the developing device shown in FIG. 9.
Figure 13:
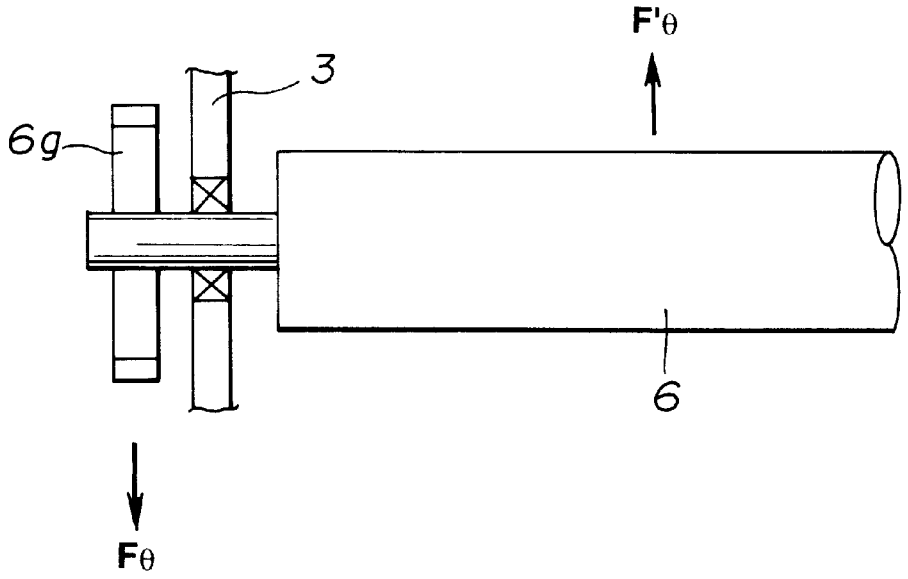
FIG. 13 is a diagram illustrating a driving reaction force exerted on the regulating sleeve in the developing device shown in FIG. 9.
Figure 14:
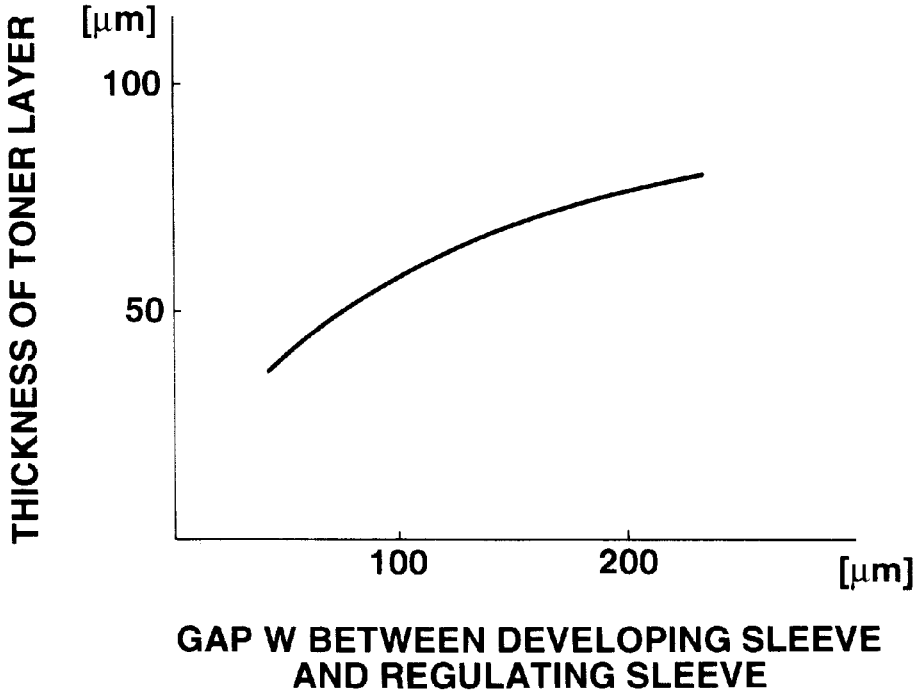
FIG. 14 is a graph illustrating the relationship between the thickness of a toner layer and the gap W between the regulating sleeve and a developing sleeve in the developing device shown in FIG. 9.

The width of the 50% value of the magnetic flux density of a magnetic pole of the magnet indicates the width PW between portions where the value of the magnetic flux density is half the peak value in the magnetic-flux-density distribution D of the magnet when no other magnets and magnetic materials are present in the vicinity of the magnet (see FIG. 11). The width of the 50% value of the magnetic flux density is also called a half-width.

In this embodiment, the magnetic flux density of the magnetic pole N1 of the magnet roller 1*b* within the developing sleeve 1*a* is set to 900 gauss, the magnetic flux density of the magnetic pole S4 of the magnet roller 6*b* within the regulating sleeve 6*a* of the regulating means 6A is set to 800 gauss, and the ratio of the width of the 50% value of the magnetic pole S4 to that of the magnetic pole N1 is set to about 0.8. By thus narrowing the width of the magnetic pole S4 compared with the width of the magnetic pole N1, the magnetic flux density of the magnetic field generated between the magnetic poles N1 and S4 is increased from the developing sleeve 1*a* toward the regulating means 6A.

The minimum distance W between the regulating sleeve 6*a*and the developing sleeve 1*a* is set to about 500 μm, and the circumferential speed of the developing sleeve 1*a* is set to be equal to the circumferential speed of the regulating sleeve 6*a*.

It has been confirmed that by setting the above-described conditions and using a magnetic toner, comprising a magnetic material contained in a resin binder of at least 10% by weight, having an average particle size of at least 5 μm, the above-described relational expressions (1) and (2) are satisfied.

Consequently, only sufficiently charged toner particles are conveyed to the developing region, and high quality images can be obtained as the result of stable development.

In the developing region, the thickness of the toner layer on the developing sleeve 1*a* is smaller than the minimum gap between the photosensitive drum 100 and the developing sleeve 1*a*. Accordingly, toner particles on the developing sleeve 1*a* move and reach the surface of the photosensitive drum 100 to develop the electrostatic latent image. In order to improve the efficiency of development by such a non-contact phenomenon, a vibrating bias voltage, obtained by superposing a DC voltage V1 from a power supply on an AC voltage, is applied to the developing sleeve 1*a*. A DC bias voltage V2 may also be applied to the developing sleeve 1*a*.

In the present embodiment, by also applying the same bias voltage to the regulating sleeve 6*a* as the bias voltage applied to the developing sleeve 1*a*, the regulating sleeve 6*a* is maintained at the same potential as the potential of the developing sleeve 1*a*.

Figure 1:
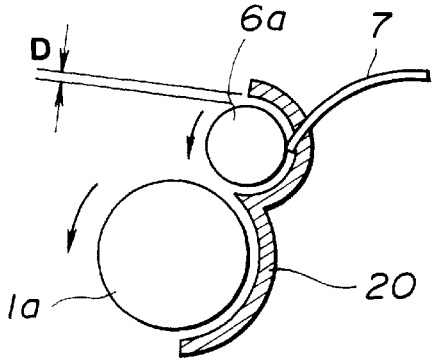
FIG. 1 is a partial cross-sectional view of a developing device according to a first embodiment of the present invention.
Figure 2:
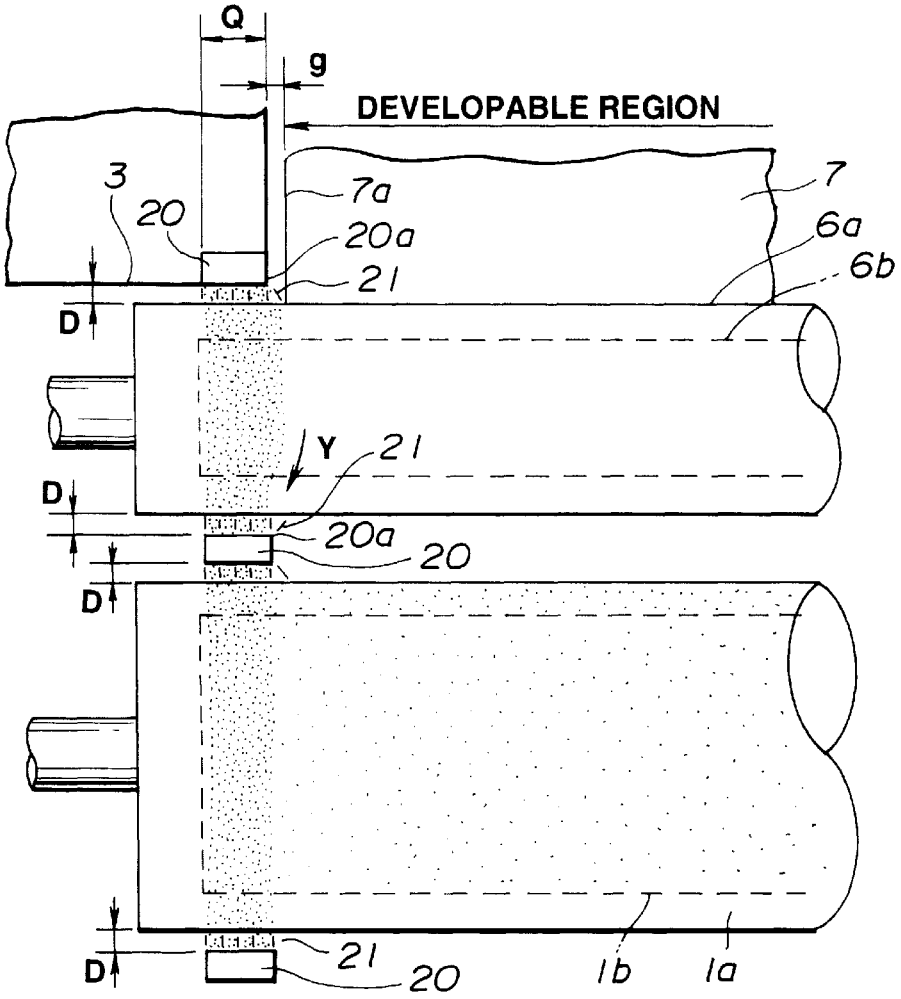
FIG. 2 is a front view of the developing device shown in FIG. 1.

FIGS. 1 and 2 illustrate the configuration of sealing members for preventing leakage of toner particles from the end portions of the sleeves, which constitute another feature of the present invention.

As shown in FIG. 1, plates 20 made of a magnetic material, each having an E-shaped cross section, are disposed at a gap D from the circumferential portions of the developing sleeve 1*a* and the regulating sleeve 6*a*, and serve as a coating member thickness regulating means. The magnetic plates 20 have a width Q, and, as can be seen in FIG. 2, are disposed at end portions of the sleeves so that the developable region is situated between the magnetic plates 20. The ends of the magnet roller 1*b* within the developing sleeve 1*a* and the ends of the magnet roller 6*b* within the regulating sleeve 6*a* are arranged to substantially coincide with the ends of the magnetic plates 20. The scraper 7, serving as a cleaning member, is arranged so as to provide a gap g with the ends of the magnetic plates 20. The distal end of the scraper 7 contacts the surface of the regulating sleeve 6*a* to clean toner particles adhering thereto.

According to the above-described configuration, a magnetic force as indicated by lines of force 21 (FIG. 2) is generated between the magnetic plates 20 and the magnet rollers 6*b* and 1*b*. This magnetic force is exerted in the direction of the radius of each of the sleeves. Hence, when toner particles are held in this space, the outflow of the toner particles in the axial direction can be prevented. That is, by continuously surrounding the surfaces of the developing sleeve 1*a* and the regulating sleeve 6*a* with the magnetic plates 20, at one end a single magnetic plate can seal portions of both the developing sleeve 1*a* and the regulating sleeve 6*a*. Since the magnetic plates 20 do not contact the developing sleeve 1*a* and the regulating sleeve 6*a*, it is unnecessary to increase the driving torque.

Furthermore, since the scraper 7 is disposed so that its end 7*a* is separated from each of the magnetic plates 20 with the gap g, the elastic force of the scraper 7 is not hindered, and therefore the scraper 7 can assuredly clean toner particles on the regulating sleeve 6*a*. It is also possible to absorb variations in dimensions due to backlash during an assembling operation or a limitation in accuracy in processing of components with this gap g. Hence, even if dimensional variations are present, the end 7*a* of the scraper 7 can always and assuredly be made to be in pressure contact with the regulating sleeve 1*a*. When the gap g is provided between the scraper 7 and each of the magnetic plates 20, toner particles tend to flow from the gap g onto the regulating sleeve 6*a*. However, since the magnetic force is concentrated near an edge 20*a* of the magnetic plate 20, toner particles are drawn within the region of the width Q of the magnetic plate 20, as indicated by an arrow Y shown in FIG. 2. Therefore, outflow of toner particles does not occur. However, if the gap g is too large, the drawing ability of the magnetic force becomes insufficient, and toner particles are accumulated on the regulating sleeve 6*a*in the form of a band having a width equal to the gap g. In practice, the gap is preferably equal to or less than about 2 mm, though it depends on the magnetic force of the magnet roller, and the like.

By using the scraper 7 having the above-described configuration, it is possible to freely set the contact pressure, the contact position and the like of the scraper 7 while maintaining sealability of toner particles, and to easily arrange sealing units and the end of the scraper 7.

Figure 3:
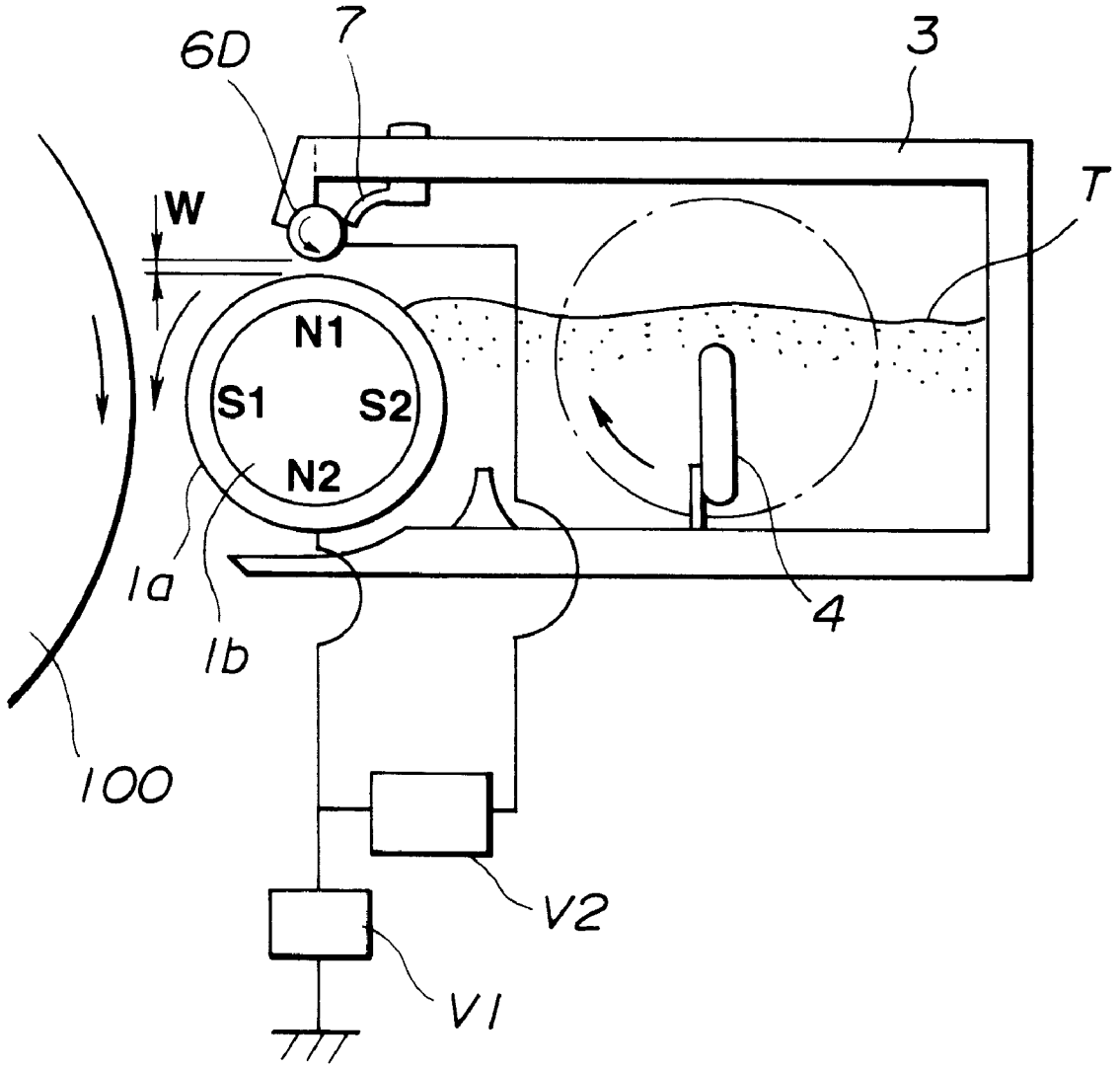
FIG. 3 is a cross-sectional view illustrating a developing device according to a second embodiment of the present invention.

FIG. 3 illustrates a developing device according to a second embodiment of the present invention.

In the second embodiment, a regulating roller 6D made of a material, such as iron or the like, which is magnetized by a magnetic field, is used as thickness regulating means disposed so as to face the developing sleeve 1*a*.

The regulating roller 6D is arranged to face a magnetic pole, i.e., the magnetic pole N1 in the present embodiment, of the magnet roller 1*b* disposed within the developing sleeve 1*a* so as to be in the magnetic field from the magnetic pole N1, and is rotated in the same direction as the developing sleeve 1*a*. The diameter of the regulating roller 6D is smaller than the half-width of the magnetic pole N1, so that the magnetic flux density between the magnetic pole N1 and the regulating roller 6D increases toward the regulating roller 6D.

More specifically, by making the magnetic flux density of the magnetic pole N1 of the magnet 1*b* 1000 gauss, and making the ratio of the diameter of the regulating roller 6D to the half-width of the magnetic pole N1 less than 0.4, the magnetic flux density between the magnetic pole N1 and the regulating roller 6D increases toward the regulating roller 6D.

As a result, as in the first embodiment, it is possible to convey a necessary amount of only sufficiently charged toner particles to the developing region and to obtain high quality images as a result of more stable development.

Figure 4:
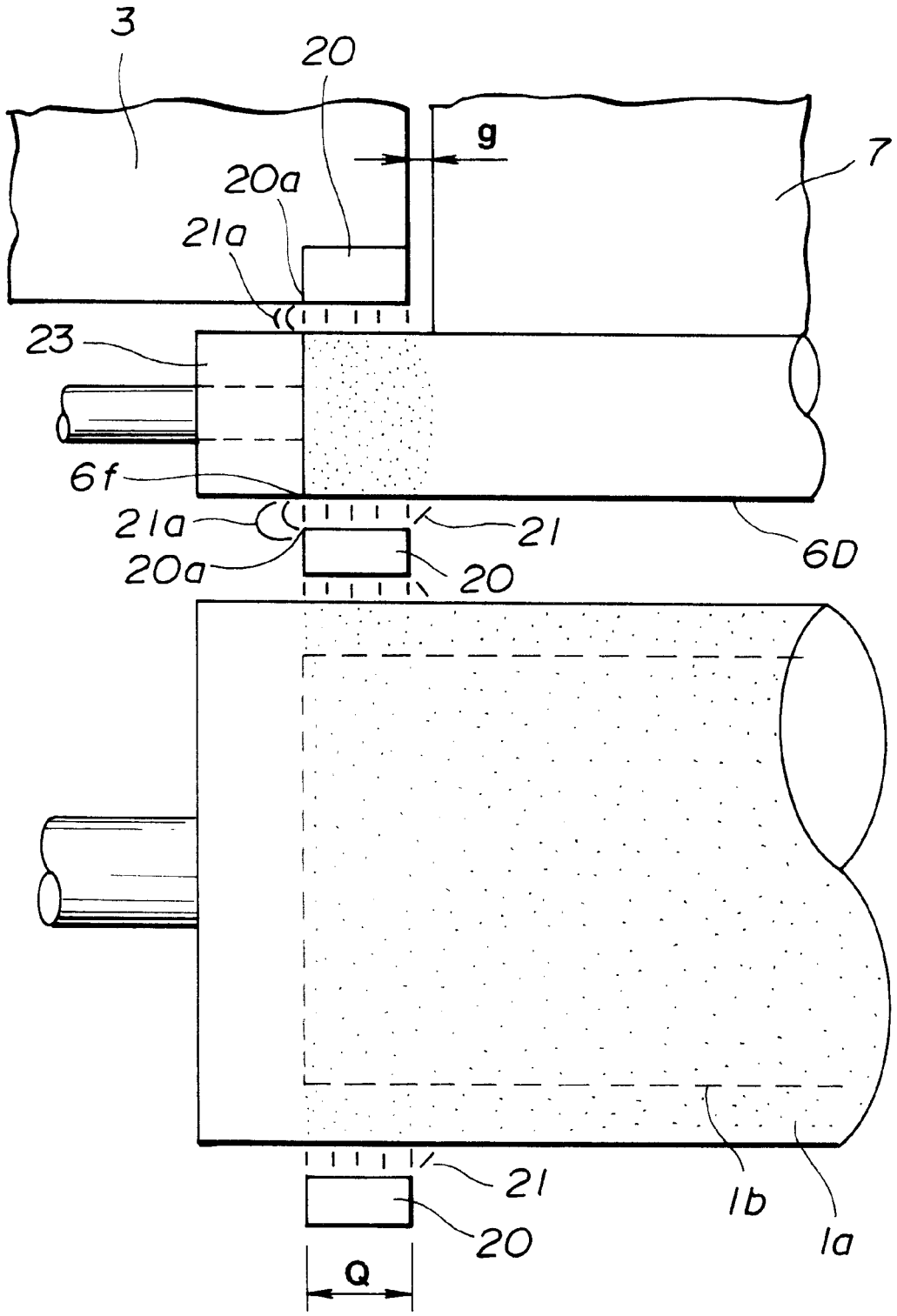
FIG. 4 is a front view of the developing device shown in FIG. 3.

FIG. 4 illustrates a state of sealing at an end portion when using such a regulating roller. The configuration of continuously disposing magnetic plates having a width Q along circumferential portions of the developing sleeve and the regulating roller is the same as that described in the first embodiment. The configuration of disposing the scraper 7 with a gap g is also the same as that in the first embodiment. As described above, since the regulating roller D is made of a magnetic material, a magnetic force as indicated by magnetic lines of force 21*a* is exerted between an edge 6*f* of the regulating roller 6D and the edge 20*a* of the magnetic plate 20. Hence, toner particles move along the surface of the regulating roller 6D and tend to flow to the outside in the axial direction. In order to prevent such movement of toner particles, collars 23 made of a nonmagnetic material are disposed at the ends of the regulating roller 6D. Thus, toner particles do not flow from the ends of the regulating roller 6D.

The configuration of sealing for preventing leakage of toner particles from the ends of the sleeves has thus been described.

Figure 5:
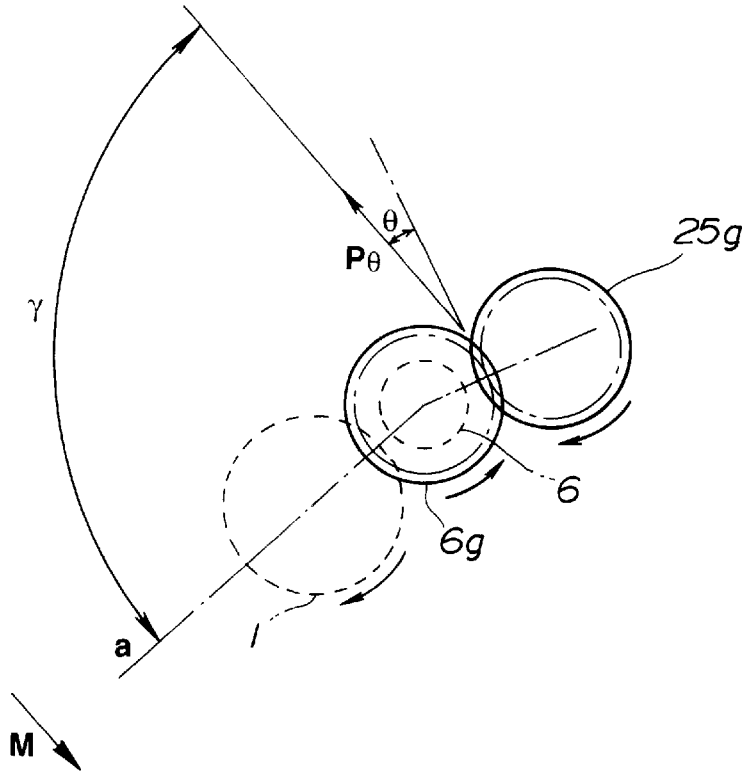
FIG. 5 is a diagram illustrating the configuration of an input to drive a thickness regulating means in the present invention.
Figure 6:
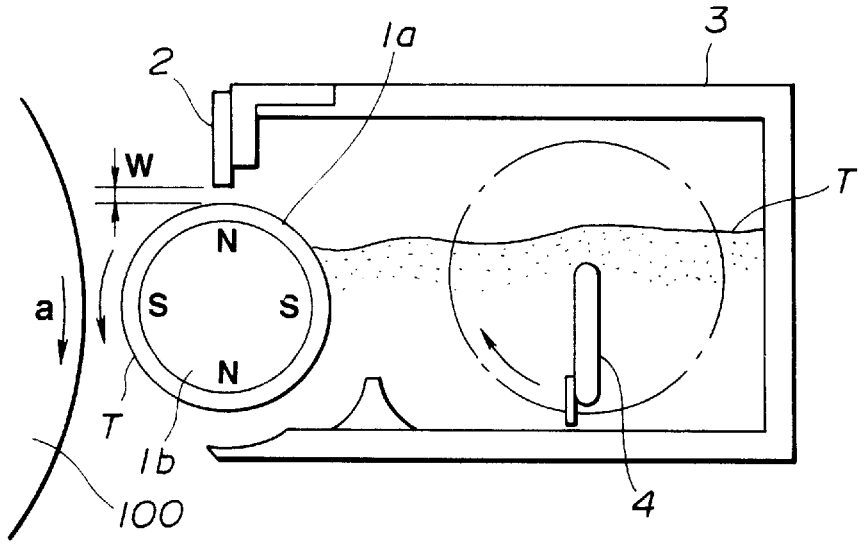
FIG. 6 is a cross-sectional view illustrating a conventional developing device including a magnetic blade.
Figure 7:
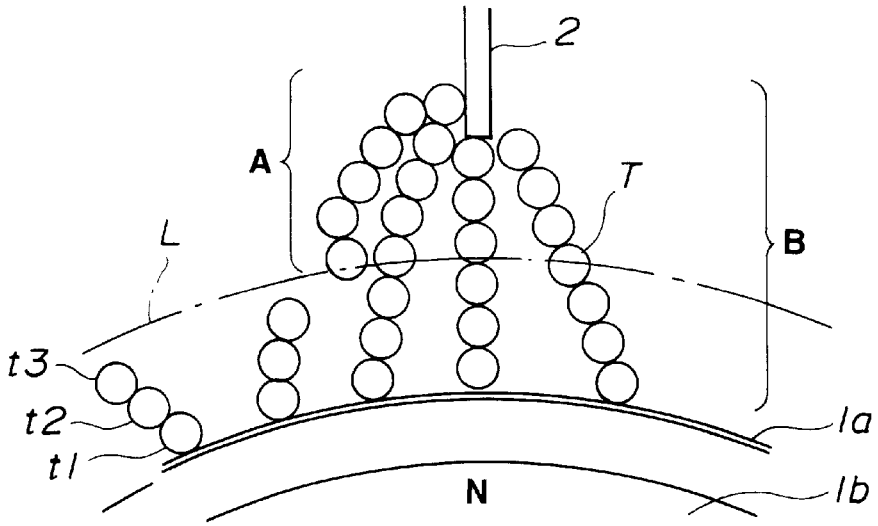
FIG. 7 is a diagram illustrating a state of toner particles in the vicinity of the magnetic blade in the developing device shown in FIG. 6.
Figure 8:
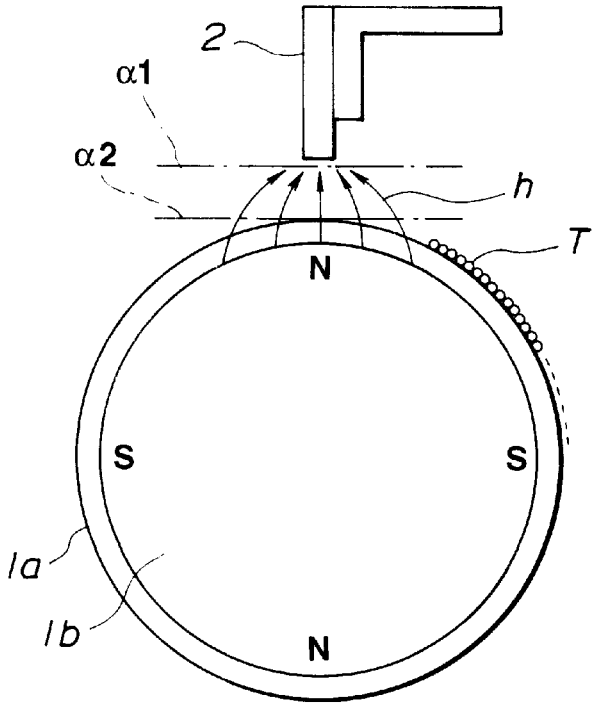
FIG. 8 is a diagram illustrating a state of a magnetic flux density in the vicinity of the magnetic blade in the developing device shown in FIG. 6.

Next, the configuration of an input for driving the regulating sleeve or the regulating roller will be described. FIG. 5 illustrates the outline of the drive configuration. A force $P_\theta$ is generated between the gear 6*g* of the regulating sleeve 6 and the gear 25*g* meshing with it. A line connecting the center of the regulating sleeve 6 to the center of the developing sleeve 1 is indicated by "a". The angle $\gamma$ made by the force $P_\theta$ and the line "a" is arranged substantially equal to a right angle. As described above, the regulating sleeve 6 is deflected due to the force $P_\theta$ generated between the gears. The direction of the deflection is indicated by M in FIG. 5.

However, since the angle $\gamma$ is arranged to be substantially a right angle, the direction of the deflection is substantially orthogonal to the line "a". As a result, a change in the gap W between the sleeves due to the deflection of the regulating sleeve is very small.

Accordingly, the thickness of the toner layer in the axial direction of the sleeve is minimally influenced by the deflection of the regulating sleeve, and therefore can be maintained substantially constant.

The individual components shown in outline in the drawings are all well known in the developing device arts and their specific construction and operation are not critical to the operation or the best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A developing device comprising:

a rotating developer carrying member for carrying a magnetic developer;

a regulating rotating member for regulating the thickness of the developer on said developer carrying member;

a magnetic-field generation means for generating a magnetic field between said developer carrying member and said regulating rotating member; and a magnetic member, provided at an end portion of each of said developer carrying member and said regulating rotating member disposed along the circumferences thereof, said magnetic member, said developer carrying member, and said regulating rotating member being disposed relative to one another such that a gap exists therebetween.

2. A developing device according to claim 1, wherein said magnetic-field generation means comprises a first magnet provided within said developer carrying member and a second magnet provided within said regulating rotating member.

3. A developing device according to claim 1, wherein the magnetic developer comprises a magnetic toner.

4. A developing device according to claim 1, wherein the moving direction of said regulating rotating member at a portion where said regulating rotating member faces said developer carrying member is opposite to the moving direction of said developer carrying member.

5. A developing device according to claim 1, wherein said magnetic-field generation means generates a magnetic field such that a magnetic flux density increases from said developer carrying member toward said regulating rotating member.

6. A developing device according to claim 1, further comprising a scraping member for scraping the developer on said regulating rotating member, wherein said magnetic member is provided outside said scraping member.

7. A developing device according to claim 6, wherein the gap between said magnetic member and said scraping member is equal to or less than 2 mm.

8. A developing device according to claim 6, wherein said magnetic member is provided so as to overlap with a scraping portion of said scraping member in the circumferential direction of said regulating rotating member.

9. A developing device according to claim 1, wherein said magnetic member has an E-shaped cross section.

10. A developing device according to claim 1, wherein said magnetic member is provided at each end of each of said developer carrying member and said regulating rotating member.

* * * * *

UNITED STATES PATENT AND TRADEMARK OFFICE

CERTIFICATE OF CORRECTION

PATENT NO. : 5,913,094

DATED : June 15, 1999

INVENTOR(S) : SAIJIRO ENDO, et al.

It is certified that error appears in the above-identified patent and that said Letters Patent is hereby corrected as shown below:

COLUMN 6,
Line 5, "applies" should read --applies to--; and
Line 8, "face" should read --facing--.

COLUMN 7,
Line 11, "6aand" should read --6d and--.

COLUMN 8,
Line 27, "6ain" should read --6a in--.

Signed and Sealed this

Thirty-first Day of October, 2000

*Attest:*

*Attesting Officer*

Q. TODD DICKINSON

*Director of Patents and Trademarks*